United States Patent [19]

Williams

[11] Patent Number: 4,922,561

[45] Date of Patent: May 8, 1990

[54] CONVERTIBLE SOFA-BED

[76] Inventor: Paul Williams, "Mobeetly", Enfield St. East, Penrith. N.S.W. 2750, Australia

[21] Appl. No.: 179,470

[22] PCT Filed: Jun. 12, 1987

[86] PCT No.: PCT/AU87/00171

§ 371 Date: Feb. 8, 1988

§ 102(e) Date: Feb. 8, 1988

[87] PCT Pub. No.: WO87/07487

PCT Pub. Date: Dec. 17, 1987

[30] Foreign Application Priority Data

Jun. 12, 1986 [AU] Australia ..... PH6379
Aug. 25, 1986 [AU] Australia ..... PH7641

[51] Int. Cl.[5] ..... A47C 17/04

[52] U.S. Cl. ..... 5/9 R; 5/12 R; 5/45; 297/62

[58] Field of Search ..... 5/9 R, 12 R, 37 R, 38, 5/43, 45, 118; 297/62, 112

[56] References Cited

U.S. PATENT DOCUMENTS

| | | | |
|---|---|---|---|
| 591,095 | 10/1897 | Evans | 297/62 |
| 961,138 | 6/1910 | Joselin | 5/45 |
| 2,569,999 | 10/1951 | Lowry | 5/45 |
| 2,627,612 | 2/1953 | Ekeberg | 297/62 X |
| 3,246,347 | 4/1966 | Mason | 5/9 R |
| 3,310,815 | 3/1967 | Griffin | 5/12 R X |
| 3,736,601 | 6/1973 | Riches | 5/9 R |
| 3,986,218 | 10/1976 | Mizelle . | |

FOREIGN PATENT DOCUMENTS

| | | | |
|---|---|---|---|
| 11611 | 4/1953 | Australia . | |
| 16122 | 4/1953 | Australia . | |
| 36670 | 10/1959 | Australia . | |
| 7616 | 2/1964 | Australia . | |
| 28592 | 11/1984 | Australia . | |
| 41844 | 11/1985 | Australia . | |
| 189525 | 10/1906 | Fed. Rep. of Germany . | |
| 881251 | 6/1953 | Fed. Rep. of Germany | 5/12 R |
| 2241842 | 3/1979 | Fed. Rep. of Germany | 5/9 R |
| 132252 | 1/1921 | United Kingdom | 5/9 R |
| 940375 | of 1963 | United Kingdom . | |
| 1028036 | 5/1966 | United Kingdom | 5/9 R |

*Primary Examiner*—Michael F. Trettel

[57] ABSTRACT

A sofa which is selectively convertible into a double bed or a double bunk consists of a base (10) and a back (11) which constitutes the sofa back, part of the double bed and the upper bunk according to the mode of the sofa. The back (11) and base (10) are connected by a mechanism which includes front posts (5) and rear posts (6,9) which are collapsible and slidable with respect to the base (10). The front posts (5) are slidable with respect to the back (11) to achieve the double bunk mode.

16 Claims, 7 Drawing Sheets

CONVERTIBLE SOFA-BED

FIELD OF INVENTION

This invention relates to convertible furniture and more particularly to a sofa or the like that may be converted to a bed.

BACKGROUND ART

Sofas which convert to a bed are well known—see, for example U.S. Pat. Nos. 3,310,815; 3,191,194; 3,858,254; 3,736,601 and 2,835,901.

Such prior art sofa beds suffer from a number of disadvantages including the difficulty of effecting conversion. For example, prior art convertible sofas are not normally operable by a single person and even if they are, the task is a cumbersome one. Furthermore, access must usually be provided to either the back or the ends of the sofa to effect the conversion to the bed.

It is an object of the invention to provide an improved convertible sofa having a mechanism which permits simple and rapid conversion to a bed. It is a further object of the invention to provide a sofa which may be converted to a double bunk. Yet another object of the invention is to provide a sofa which may be selectively converted to a double bunk or to a double bed. It is an additional object of the invention to provide a sofa which may be converted to a double bed.

DISCLOSURE OF INVENTION

In accordance with one aspect of the invention there is provided a convertible sofa comprising a base, a back and a mechanism connecting the back to the base characterised in that by the action of the mechanism, the sofa can be converted into a double bunk with the back disposed above the base.

In accordance with another aspect of the invention there is provided a convertible sofa comprising a base, a back and a mechanism connecting the back to the base characterised in that by the action of the mechanism the sofa can be converted to a double bed with the back adjacent to the base.

In accordance with yet another aspect of the invention there is provided a convertible sofa comprising a base, a back and a mechanism connecting the back to the base characterised in that by action of the mechanism the sofa can be selectively converted to either a double bunk or a double bed.

BRIEF DESCRIPTION OF THE DRAWINGS

In order that the invention may be more readily understood and put into practical effect, reference will now be made to the accompanying drawings in which.

Figure 1:
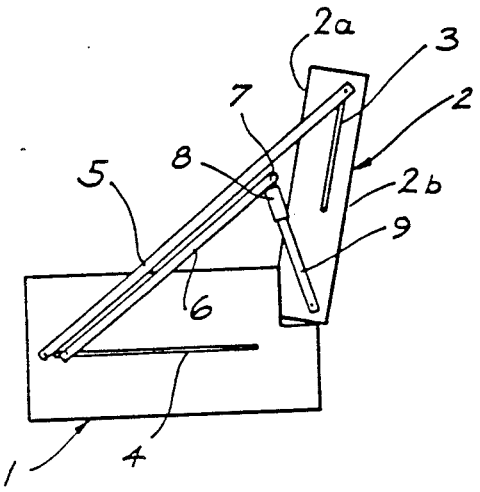
FIG. 1 is a side elevational view of a convertible sofa according to one embodiment of the invention.

The sofa shown in FIG. 1 has a base 1 of any convenient kind and a back 2 having a front face 2*a* and a rear face 2*b*. The base 1 and the back 2 are connected together by a mechanism at each end of the sofa only one of which is shown in FIG. 1.

The mechanism includes a front post or member 5 connected between the front of the base 1 and the top of the back 2. The lower end of the front post 5 is pivotally connected to the base 1 at or adjacent to the front end of a slideway 4 formed in or mounted within the end of the base 1. The upper end of the front post 5 is pivotally connected to the back 2 at or adjacent to the top of a slideway 3 formed in or mounted within the end of the back 2.

The mechanism also includes a rear beam or post which consists of a first beam 6 and a second beam 9 pivotally connected together by a joint 7. The lower end of the second beam 9 is pivotally connected at or adjacent to the lower end of the back 2 and the lower end of the first beam 6 is slidable within the slideway 4 of the base 1. A sleeve 8 on the second beam 9 can be moved over the joint 7 to lock the beams 6 and 9 into linear alignment.

Figure 2:
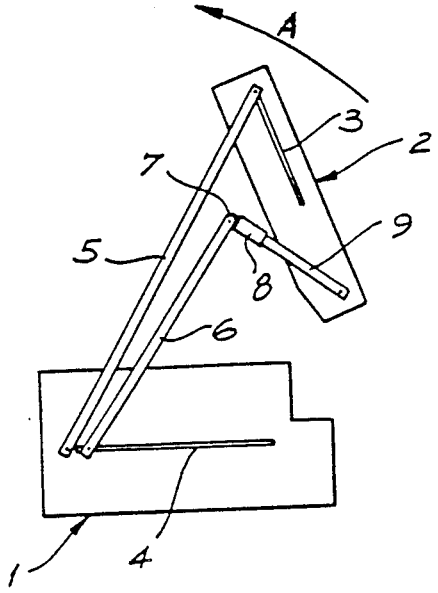
FIGS. 2 to 4 show the conversion of the sofa in FIG. 1 to a double bunk; and, FIGS. 5 to 7 show the conversion of the sofa in FIG. 1 to a double bed.

In order to convert the sofa to a double bunk, the back 2 of the sofa is pulled forwardly and upwardly as indicated by arrow A in FIG. 2. It will be appreciated that the action may be carried out by a person standing at the front of the sofa. If need be (i.e. if the design of the post and slideway arrangement so requires it) the post 5 is locked into its correct position by an automatically acting spring loaded device within the base 1.

Figure 3:
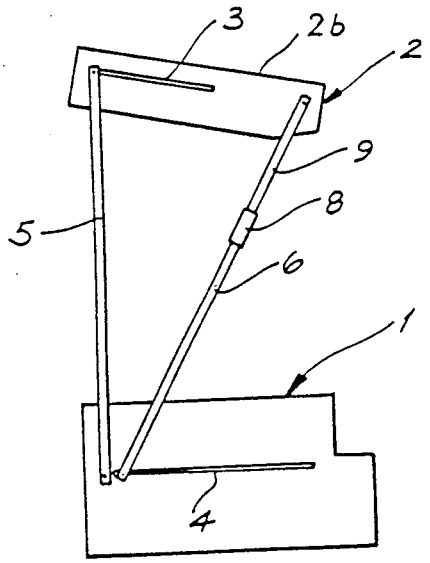

When the back has been moved sufficiently to bring the beams 6 and 9 into alignment (see FIG. 3), the sleeve 8 is located over the joint 7 to lock the beams 6 and 9 into linear alignment. This locking action occurs simultaneously at each end of the sofa. As soon as the sleeve 8 is in its locking position, the lower end of beam 6 is pushed rearwardly along the slideway 4 until it is automatically locked at the rear end of the slideway 4. The mechanism at each end of the sofa may be connected together by a pulley and cable system to ensure simultaneous movement of both mechanisms.

Figure 4:
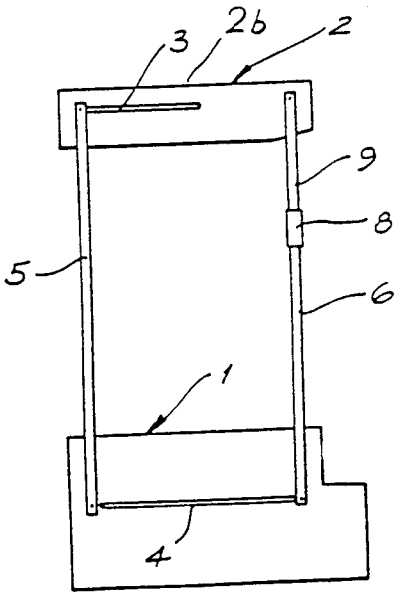

The final configuration of the double bunk is shown in FIG. 4 where it will be noted that the rear face 2*b* of the back 2 consitutes the upper bed which is supported above the lower bed formed by the base 1 by the front posts 5 and rear posts comprises of members 6 and 9. Both the base 1 and the back 2 are appropriately upholstered to provide a comfortable sofa and a comfortable bed.

Figure 5:
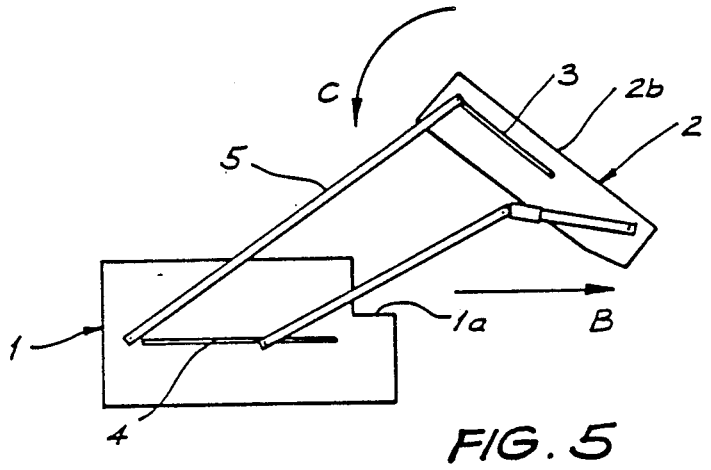
Figure 6:
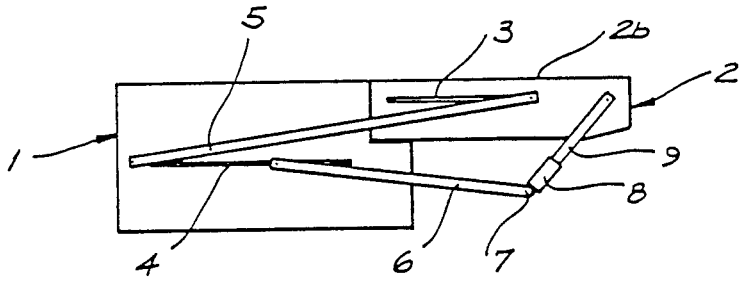
Figure 7:
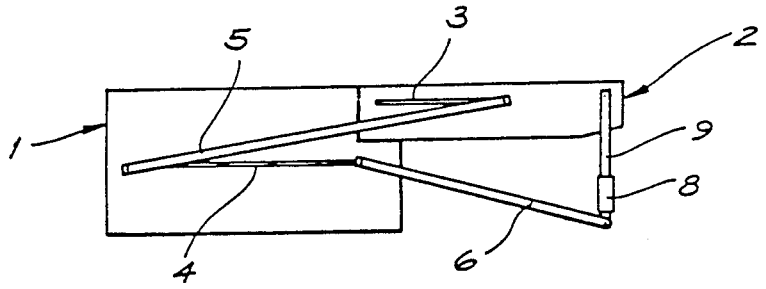

The conversion of the sofa to a double bed is shown in FIGS. 5 to 7. The lower end of the back 2 is pulled outwardly away from the base 1 in the direction of arrow B and the top of the back 2 is rotated downwardly in the direction of arrow C as shown in FIG. 5.

The base 1 has a recess portion 1*a* which initially receives the lower portion of the back 2 and which receives the top portion of the back 2 as shown in FIG. 6. As indicated, the post 5 moves outwardly in slideway 3 so that the top portion of the back 2 may be supported by the recess 1*a*. The rear 2*b* of the base 2 is then co-planar with the top of the base 1.

Finally, the lower end of beam 6 is moved outwardly in the slideway 4 until beam 9 is locked in the vertical position shown in FIG. 7 to provide a support leg. The beams of the mechanism at the other end of the sofa a re moved simultaneously through the action of a cable and pulley system which may be part of or additional to the abovementioned cable and pulley system. Preferably, the front post 5 and the beams 6 and 9 are automatically locked into the position shown in FIG. 7.

The mechanisms may be spring biased to assist the movement of the back to and from its selected position. Needless to say, the conversion of either the double bunk or the double bed back to the sofa necessitates a reversal of the steps described above.

Although the embodiment of the invention so far described is fully convertible from a sofa to a double bunk or to a double bed, the design may be simply modified so that conversion only to a double bed or to a double bunk is possible. Thus, the invention is to be construed to cover both the single conversion to either a double bunk or to a double bed and the optional conversion to a double bunk or double bed.

Figure 8:
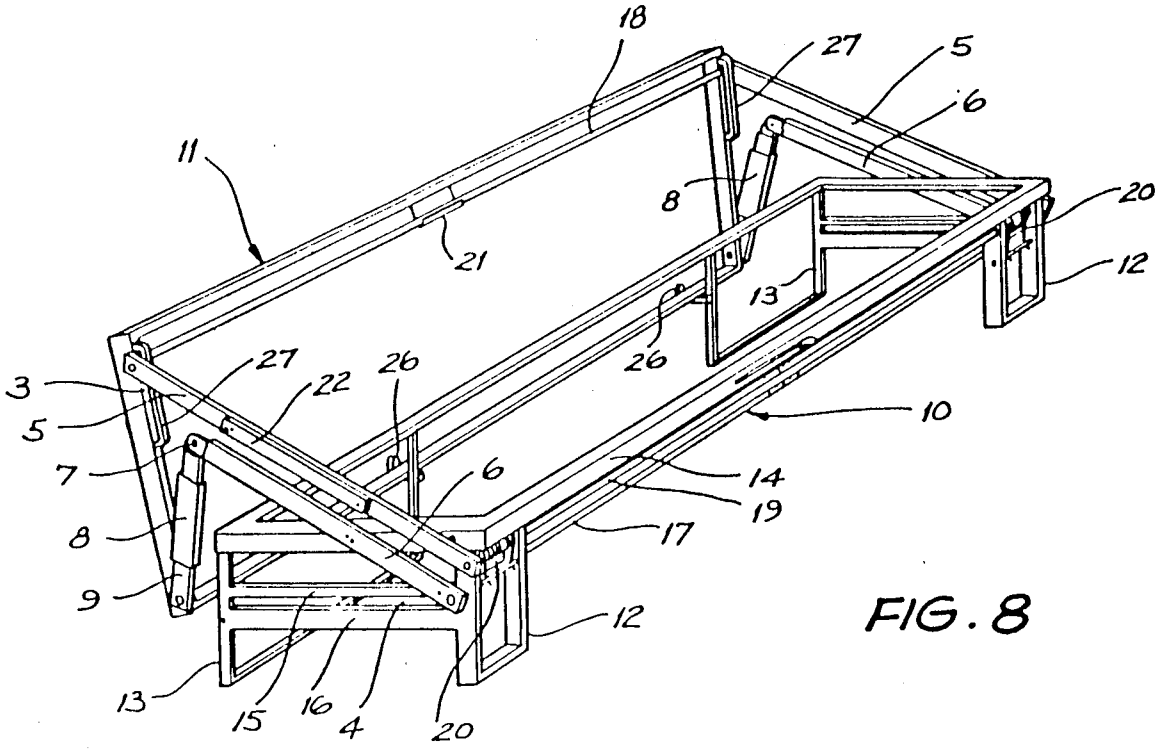
FIG. 8 is a perspective view of a convertible sofa (without uphosltery) according to a second embodiment of the invention.
Figure 9:
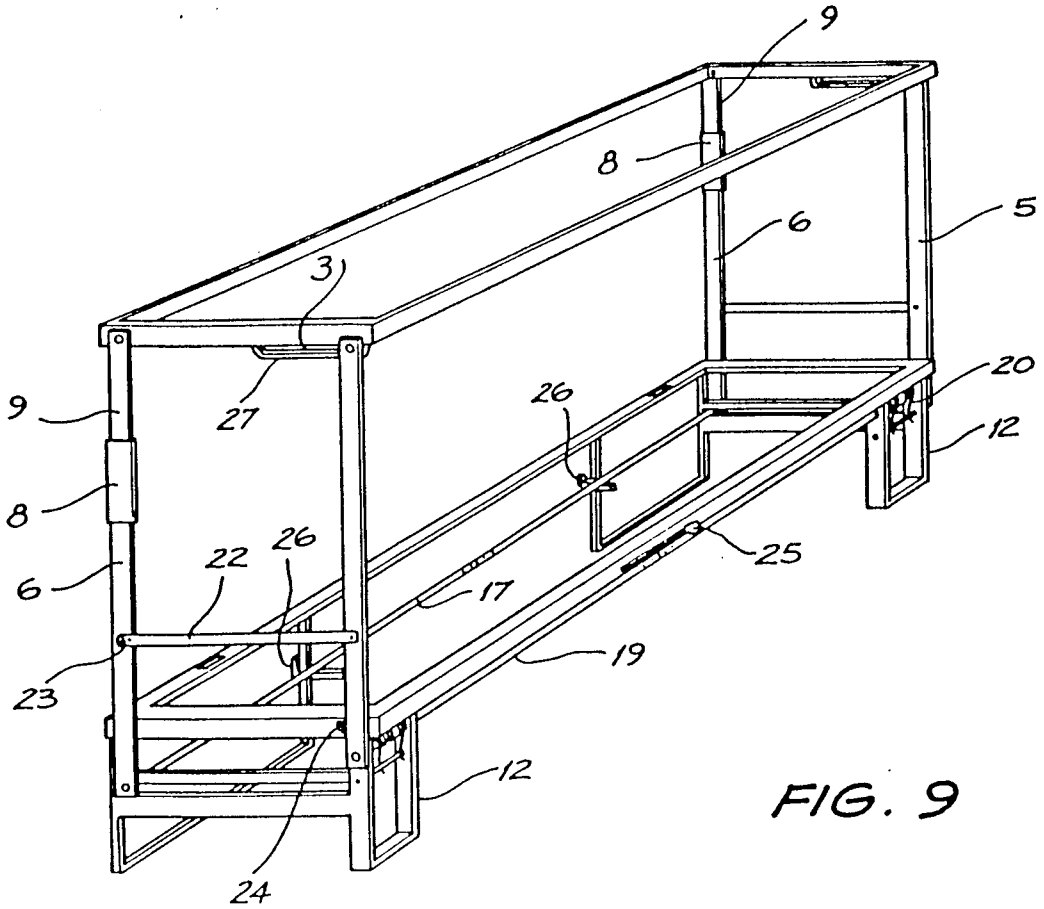
FIG. 9 is a view of the sofa shown in FIG. 8 converted to a double bunk.
Figure 10:
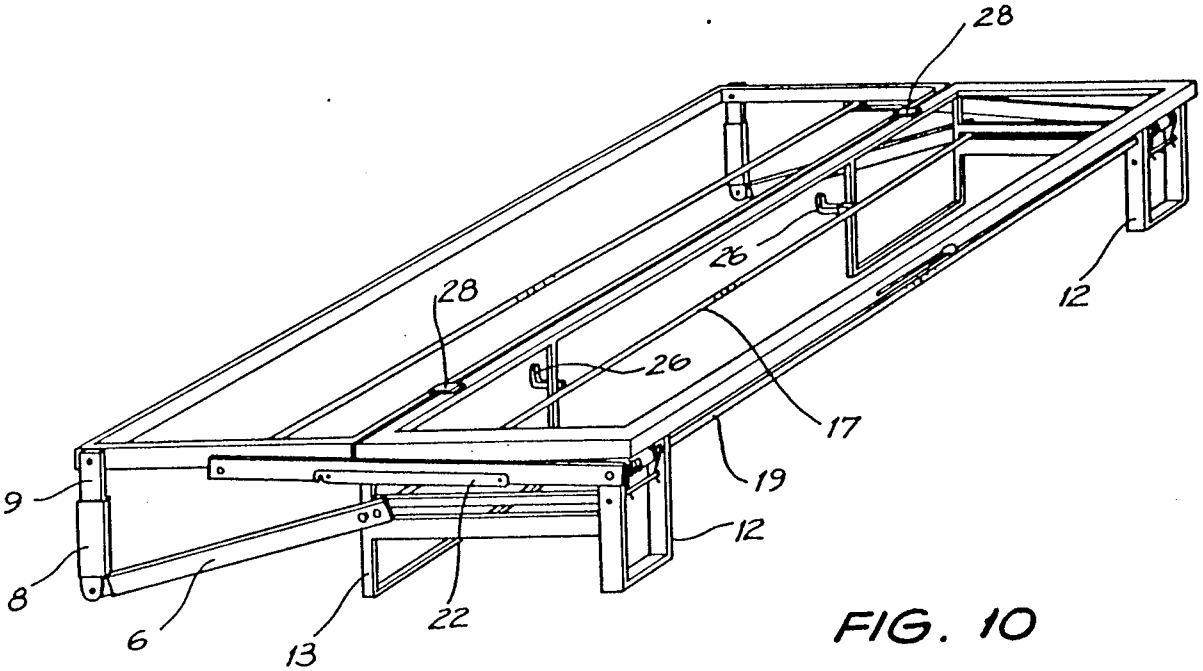
FIG. 10 is a view of the sofa shown in FIg. 9 converted to a double bed.

A second embodiment of the invention is shown in FIGS. 8 to 10. This embodiment of the invention is substantially similar to that shown in FIGS. 1 to 7 and for the sake of clarity the upholstery has been omitted. As most of the components of the second embodiment are the same or substantially similar to the components of the first embodiment, they carry the same numerals.

The sofa shown in FIGS. 8 to 10 has a base frame 10 and a movable frame 11 which constitutes the sofa back, the upper bunk or part of the double bed according to the mode of the sofa. The base frame 10 has front and rear legs 12, 13 which depend downwardly from rectangular mattress frame 14. Braces 15 and 16 which interconnect the legs 12 and 13 are spaced apart to define the slideway 4 which carries a rod 17 which connects the lower ends of the rear post 6.

The lower ends of front post 5 are connected together by a bar 19 that passes through the legs 13. The bar 19 is biased by springs 20 to assist movement of the frame 11. The upper end of the front post 5 is connected to the other post 5 by a bar 18 that moves within slideway 3 formed by the bracket 27.

The movable frame 11 is a rectangular frame that is connected to the base 10 by the front post 5 and the second part 9 of the rear post 6. The sleeve 8 may be positioned above or below the joint 7 and any convenient means may be employed to retain the sleeve in a locked position over the joint 7.

When the sofa is in the mode shown in FIG. 8, the bar 18 is held locked into position by clip 21. Also, when in this mode, the bottom of the frame 11 rests upon brackets 26 extending rearwardly from the base frame 10. When the sofa is in the double bunk mode shown in FIG. 9, stabilizer arms 22 which are pivotally mounted on front post 5 are engaged with pins 23 on the rear posts 6. Also, when in the double bunk mode, the latches 24 engage behind the front posts 5 to hold the latter in a vertical position. The latches 24 are released by lever 25 which is connected to the latches 24 by a cable (not shown).

In the double bed mode shown in FIG. 10, the front of the movable frame 11 is positioned relative to the base frame 10 by means of plates 28.

Figure 11:
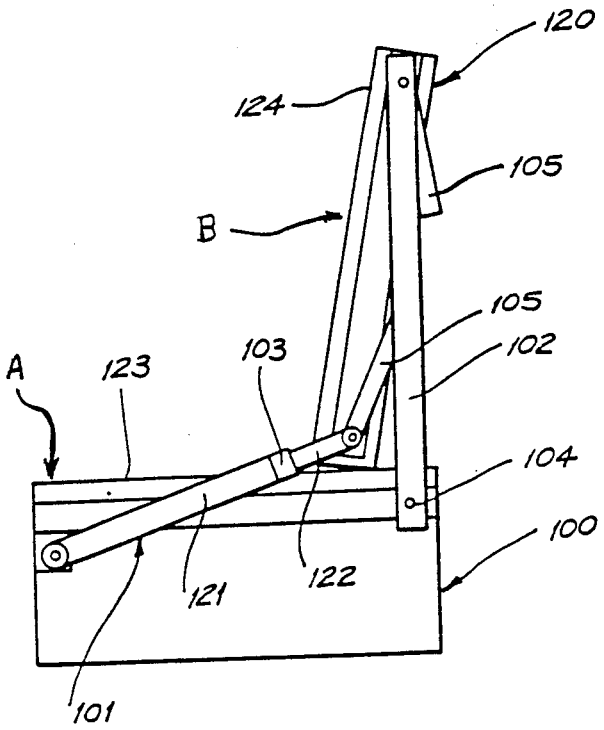
FIG. 11 is a side elevational view of a convertible sofa according to a third embodiment of the invention.
Figure 12:
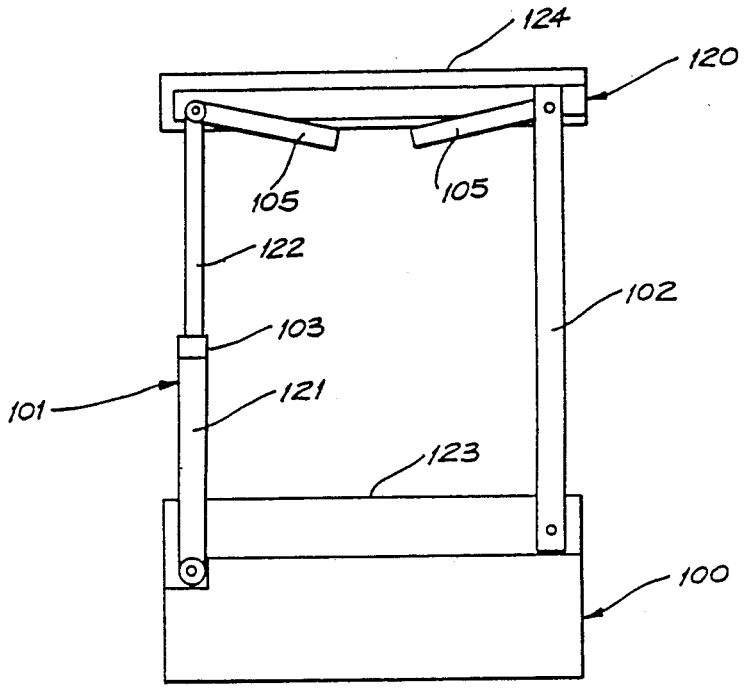
FIG. 12 is an end view of the sofa shown in FIG. 11 converted to a double bunk, and, FIG. 13 is an end view of the sofa shown in FIG. 11 coverted to a double bed.
Figure 13:
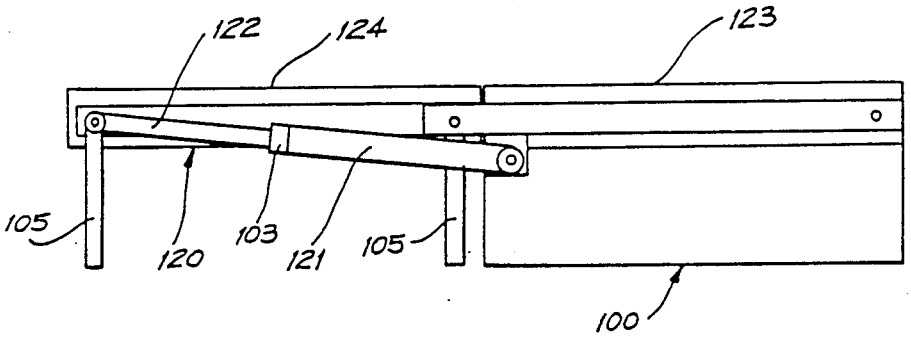

The modified sofa shown in FIGS. 11 to 13 has a base 100 of any convenient kind having a mattress 123 on its top surface and a back 120 having a mattress 124 on its front face. The base 100 and the back 120 are connected together by a mechanism at each end of the sofa only one of which is shown in FIG. 11. The mechanism includes a front member 101 having a first portion 121 pivotally connected to the front of the base 100 and a second portion 122 pivotally connected to the bottom of the back 120. The member portion 122 is slidable within the member portion 121 so that the front member may be extended as desired. Locking means 103 is provided so as to lock portion 122 relative to portion 121.

A rear post 102 is pivotally connected to the rear of the base 100 and to the top of the back 120. Legs 105 are connected to the bottom and top of the back 120.

In order to convert the sofa to a double bunk (FIG. 12), the strut or upright 102 is locked in its vertical position and the bottom of the sofa back 120 is swung outwards and upwards until it is parallel to the base 110. The front member 101 is now vertical and the extension of portion 122 with respect to 121 is locked into position by locking means 103.

The conversion of the sofa to a double bed is shown in FIG. 13. The upright or strut 102 is unlocked and is pivoted forward about its connection 104 to the base 100. The front member 101 is pivoted in an anti-clockwise direction with the portion 122 extending outwardly from the portion 121 as shown in FIG. 13. The legs 105 are locked in the vertical position when the mattress B is co-planar with the mattress A of the base 100.

In the embodiment shown in FIGS. 11 to 13, the front member 101 comprises a gas-filled cylinder and rod assembly and the locking means 103 is a rotatable lock adapted to prevent relative movement of the cylinder and rod when in its locked position.

The sofa requires no fixed upholstery work so that the sofa covering may be washed or replaced as required.

In one form of upholstery, the sofa covering may be removed and used as a quilt for a double bed. The quilt may be unzipped to form two single bed quilts for each of the bunks.

Space for storage of pillows and blankets is available under the sofa—slide out wire drawers may be incorporated in the base.

The mechanism provides for more comfort than prior art sofa-bed actions as there are no bars across the length of the beds. The preferred geometry allows sufficient space between the top and bottom bunks for an average adult to sit without hitting the head against the top bunk.

The basic design geometry allows for considerable detail variation in the finished product so that many models are possible within different price ranges.

Various modifications may be made in details of design and construction without departing from the scope and ambit of the invention.

I claim:

1. A sofa convertible into a double bed, said sofa comprising a base having an upper surface and a lower portion, a back having a front face and a rear face, and a mechanism connected between said base and said back and movably supporting said back; said back being movable between a stable first position wherein said back is positioned in a generally upright orientation with its front face facing forwardly so that said front face functions as a backrest of said sofa, and a stable second position wherein said back is positioned horizontally adjacent to said base with said upper surface of said base substantially in the same plane as said rear face of said back so that said base and said back together function as said double bed.

2. A sofa selectively convertible into a double bed or a double bunk having an upper bunk and a lower bunk, said sofa comprising a base having an upper surface and a lower portion, a back having a front face and rear face, and a mechanism connected between said base and said back and movably supporting said back; said back being movable between a stable first position wherein said back is positioned in a generally upright orientation to function as the backrest of said sofa, a stable second position wherein said back is positioned above and spaced apart from said base a sufficient distance to allow a person to enter the space between them and to repose upon said upper surface of said base so that said base functions as said lower bunk, the rear face of said back being oriented generally horizontally and facing upwardly so that said rear face of said back functions as the upper bunk of said double bunk, and a stable third position wherein said rear face of said back is horizontally adjacent to said base with the rear face of said back oriented generally horizontally, facing upwardly and generally in the same plane as said upper surface of said base so that said base and said back together function as said double bed.

3. A convertible sofa according to any one of claims 1 and 2 wherein the mechanism includes a pair of front posts and a pair of rear posts connecting the back to the base, said rear posts being collapsible between a non-collapsed condition and a collapsed condition and being pivotally fixed with respect to the back and slidable with respect to the base.

4. A convertible sofa according to claim 3 wherein each rear post comprises first and second members pivotally connected together and means for maintaining each rear post in its non-collapsed state.

5. A convertible sofa according to claim 4 wherein the front posts are pivotally fixed with respect to the base and are slidable with respect to the back.

6. A convertible sofa according to claim 3 wherein the front posts are pivotally fixed with respect to the base and are slidable with respect to the back.

7. A convertible sofa according to any one of claims 1 and 2 wherein the mechanism includes a pair of rear posts being collapsible between a non-collapsed condition and a collapsed condition and being pivotally fixed with respect to the back.

8. A sofa convertible into a double bunk having an upper bunk and a lower bunk, said sofa comprising a base, a back and a pair of mechanisms connected between them and movably supporting said back, one of said mechanisms being at each end of said sofa; said base having an upper surface, a lower portion, a front portion and a rear portion, and said back having a front face, a rear face, a lower portion and an upper portion; said back being movable between a stable first position wherein said back is positioned in a generally upright orientation with its front face facing forwardly so that said front face functions as a backrest for said sofa; and a stable second position wherein said back is positioned above and spaced apart from said base a sufficient distance to allow a person to enter the space between them and to repose upon said upper surface of said base so that said base functions as the lower bunk, the front face of said back being oriented generally horizontally and facing upwardly so that the back functions as the upper bunk of said double bunk, each of said mechanisms comprising a first link and a second link, said first link having a longitudinally extensible section and pivotally connected between the front portion of said base and the lower portion of said back, said second link being pivotally connected at the rear portion of said base and at the upper portion of said back.

9. A sofa convertible into a double bed, said sofa comprising a base, a back and a pair of mechanisms connected between them and movably supporting said back, one of said mechanisms being at each end of said sofa; said base having an upper surface, a lower portion, a front portion and a rear portion and said back having a front face, a rear face, an upper portion and a lower portion; said back being movable between a stable first position wherein said back is positioned in a generally upright orientation with its front face facing forwardly so that said front face functions as a backrest for said sofa and a stable second position wherein said back is positioned adjacent to said base, the front face of said back being substantially in the same plane as said upper surface of said base so that said base and said back together function as a double bed, each of said mechanisms comprising a first link and a second link, said first link having a longitudinally extensible section and pivotally connected between the front portion of said base and the lower portion of said back and said second link being pivotally connected between the rear portion of said base and the upper portion of said back.

10. A sofa selectively convertible into a double bunk having an upper bunk and a lower bunk, or into a double bed, said sofa comprising a base, a back and a pair of mechanisms connected between said base and said back and movably supporting said back, one of said mechanisms being at each end of said sofa; said base having an upper surface, a lower portion, a front portion and a rear portion, and said back having a front face, a rear face, a lower portion and an upper portion; said back being movable between a stable first position wherein said back is positioned in a generally upright orientation with its front face facing forwardly so that said front face functions as a backrest for said sofa, a stable second position wherein said back is positioned above and spaced apart from said base a sufficient distance to allow a person to enter the space between them and to repose upon said upper surface of said base so that said base functions as the lower bunk, the front face of said back being oriented generally horizontally and facing upwardly so that the back functions as the upper bunk of said double bunk, and a stable third position wherein said front face of said back is horizontally adjacent to said base with the front face of said back oriented generally horizontally, facing upwardly and generally in the same plane as said upper surface of said base so that said base and said back together function as a double bed, each of said mechanisms comprising a first link and a second link, said first link being longitudinally extensible and pivotally connected between the front portion of said base and the lower portion of said back and said second link being pivotally connected between the rear portion of said base and the upper portion of said back.

11. A convertible sofa according to any one of claims 8 to 10 wherein the mechanism includes a pair of front posts and a pair of rear posts connecting the back to the base, said front posts being collapsible between a non-collapsed condition and a collapsed condition and being pivotally fixed with respect to the base and the back.

12. A convertible sofa according to any one of claims 8–10 wherein the mechanism includes a pair of front posts comprising a cylinder and rod assembly and a pair of rear posts connecting the back to the base, said front posts being collapsible between a non-collapsed condition and a collapsed condition and being pivotally fixed with respect to the base and the back.

13. A sofa convertible into a double bunk having an upper bunk and a lower bunk, said sofa comprising a base having an upper surface and a lower portion, a back having a front face and a rear face, and a mechanism connected between said base and said back and movably supporting said back; said back being movable between a stable first position wherein said back is positioned in a generally upright orientation with its front face facing forwardly so that said front face functions as a backrest of said sofa, and a stable second position wherein said back is positioned with its rear face facing generally horizontally upwardly to form substantially the entire sleeping surface of the upper bunk of said double bunk, said back being generally above and spaced apart from said base a sufficient distance to allow a person to enter the space between them and to repose upon said upper surface of said base to function as the lower bunk of said double bunk, and wherein the mechanism includes a pair of front posts and a pair of rear posts connecting the back to the base, said rear posts being collapsible between a non-collapsed condition and a collapsed condition and being pivotally fixed with respect to the back and slidable with respect to the base.

14. A convertible sofa according to claim 13 wherein each rear post comprises first and second members pivotally connected together and means for maintaining each rear post in its non-collapsed state.

15. A convertible sofa according to claim 14 wherein the front posts are pivotally fixed with respect to the base and are slidable with respect to the back.

16. A convertible sofa according to claim 13 wherein the front posts are pivotally fixed with respect to the base and are slidable with respect to the back.

* * * * *